United States Patent [19]

Staggs et al.

[11] Patent Number: 4,663,619

[45] Date of Patent: May 5, 1987

[54] MEMORY ACCESS MODES FOR A VIDEO DISPLAY GENERATOR

[75] Inventors: Kevin P. Staggs, Glendale; Charles J. Clarke, Jr., Phoenix, both of Ariz.

[73] Assignee: Honeywell Inc., Phoenix, Ariz.

[21] Appl. No.: 721,021

[22] Filed: Apr. 8, 1985

[51] Int. Cl.[4] ..... G09G 1/16

[52] U.S. Cl. ..... 340/750; 340/799; 340/747

[58] Field of Search ..... 340/735, 744, 747, 748, 340/750, 703, 798, 799

[56] References Cited

U.S. PATENT DOCUMENTS

| | | | |
|---|---|---|---|
| 4,149,145 | 4/1979 | Hartke et al. | 340/750 X |
| 4,197,590 | 4/1980 | Sukonick et al. | 340/750 X |
| 4,254,409 | 3/1981 | Busby | 340/750 X |
| 4,439,760 | 3/1984 | Fleming | 340/750 X |
| 4,447,809 | 5/1984 | Kodama et al. | 340/750 X |
| 4,496,944 | 1/1985 | Collmeyer et al. | 340/750 X |
| 4,496,976 | 1/1985 | Swanson et al. | 340/799 |
| 4,591,850 | 5/1986 | Lundström | 340/750 X |
| 4,613,852 | 9/1986 | Maruko | 340/799 |
| 4,628,467 | 12/1986 | Nishi et al. | 340/799 |

*Primary Examiner*—Gerald L. Brigance
*Attorney, Agent, or Firm*—A. A. Sapelli; A. Medved

[57] ABSTRACT

A display memory which stores information to be displayed on a raster scan CRT comprises a first storage element for storing dot information, a second storage element for storing behavior information, and a third storage element for storing characteristic information. The first, second, and third storage element are each arranged in an nxm plane where m is an addressable location and each addressable location within each plane has n bits of information. Further, each of the first, second, and third storage elements has address terminals each operatively connected to a display address bus adapted to receive address information from a CPU.

Control logic receives address signals, data signals, and control signals from the CPU. The control logic generates enable control signals to selectively enable access to predetermined combinations of said first, second, and third storage elements in response to the address, data, and control signals from the CPU.

12 Claims, 7 Drawing Figures

LATCH
58
DATA(0-4)
5
PLE
12-0
12-1
12-4
DI
WE0
WE1
WE7
CE
A
P0
P1
P4
BUS
ADDRESS
CEP
R/W
14"
BEH
DISPLAY
CEB
56
LATCH
LE
14'
DOT
CED
8
9
7
41
MUX
S
0
1
15
9
12
11
18
19
A(0-8)
A(9-15)
A(9-19)
48
MUX
4:1
E
A
B
C
D
HIGH
52
DECODER
CONTROL
S0
S1
A(13-19)
FAST CLEAR
45
1 OF 8
DECODER
DATA BUS (0-7)
ADDRESS BUS A(0-19)
FAST CLEAR (FC)
R/W
FROM GRAPHIC CONTROLLER IO

MEMORY ACCESS MODES FOR A VIDEO DISPLAY GENERATOR

BACKGROUND OF THE INVENTION

This invention relates to a raster graphic display system, and more particularly, to an improved display memory organization and apparatus for accessing the display memory.

Raster scan CRT displays form a principal communication link between computer users and their hardware/software systems. The basic display device for computer-generated raster graphics is the CRT monitor which is closely related to a standard television receiver. To achieve the full potential of raster graphic systems, such systems require digital computational support substantially in excess of that provided by the typical CRT monitor. The development of large-scale integrated circuits and microcomputers makes it possible to control such displays at affordable prices. Typically, each picture element (pixel) of a substantially rectangular array of such elements of a CRT comprising the raster is assigned a unique address, which address is comprised of the x and y coordinates of each pixel in the array. Information to control the display of a pixel, its color and intensity, pixel control information, is stored in a random-access pixel memory at a location having an address corresponding to that of the pixel. The source of such pixel control information is typically a microcomputer located in a graphic controller. Such pixel control information may include the address in a color look-up memory at which location there is stored binary control signals which are used to control the intensity and color of each pixel of the array as it is scanned. In existing systems, the display memory (which includes the pixel memory) has been contiguous. In other words, if there are fifty pixels on a display line, the address of the first pixel on the first line would be 0, the address of the second pixel would be 1, the address of the third pixel would be 2, . . . , and the address of the first pixel on the second line would be 50. In order to determine the display memory address of the 49th pixel on the 102nd line, the following algorithm, 50 times 102 plus 49 would need to be calculated. Multiplication typically is one of the slowest of the instructions in any microprocessor. Characters to be displayed on a CRT are transferred from a font memory to the display memory. Such a transfer operation would require a multiple number of writes into display memory, with the corresponding address calculation (e.g., for a character of 16 lines, 16 address calculations and 16 writes into display memory would be required). Similarly, drawing vertical lines would require multiple address calculations and a corresponding write of the display memory. Also, some existing systems will blank the CRT display when writing to the display memories during the scan of the active display area, or only allow writing to the display memories during the retrace times.

Thus, there is a need for a display memory organization, and associated apparatus for accessing the display memory, which provides a more time efficient manner to load the display memory with the character(s) to be displayed on the CRT, a more efficient way to generate the graphics (more specifically, for the generation of vertical lines for display), and providing a way of accessing the display memory without resulting in blanking the display.

SUMMARY OF THE INVENTION

Therefore, there is supplied by the present invention apparatus for accessing, or writing data into, a display memory. In a data processing system of the present invention there is included a display system. The display system includes a central processing unit (CPU) and a display memory, a random access memory, for storing information to be displayed. The display memory comprises a first storage element which stores binary dot information, a second storage element which stores binary behavior information, and a third storage element, operatively connected to the first storage element, which stores binary characteristic information. The first, second, and third storage element are each arranged in an nxm plane where m is the number of addressable location and each addressable location within each plane stores n bits of information. Further, each of the first, second, and third storage elements has address terminals each operatively connected to a display address bus adapted to receive address information from the CPU.

Control logic having input terminals adapted to receive address signals, data signals, and control signals from the CPU, is operatively connected to first, second, and third storage element. The control logic write generates enable control signals to selectively enable access to predetermined combinations of the first, second, and third storage element in response to the address, data, and control signals from the CPU.

Accordingly, it is an object of the present invention to provide an apparatus for accessing a display memory.

It is another object of the present invention to provide a display memory organized to be loaded in a more time-efficient manner with characters to be displayed on a CRT.

It is still another object of the present invention to provide an apparatus for accessing a display memory organized to correspond with an apparent vertical raster scan.

These and other objects of the present invention will become more apparent when taken in conjunction with the following description and attached drawings, wherein like characters indicate like parts, and which drawings form a part of the present application.

DETAILED DESCRIPTION

Figure 1:
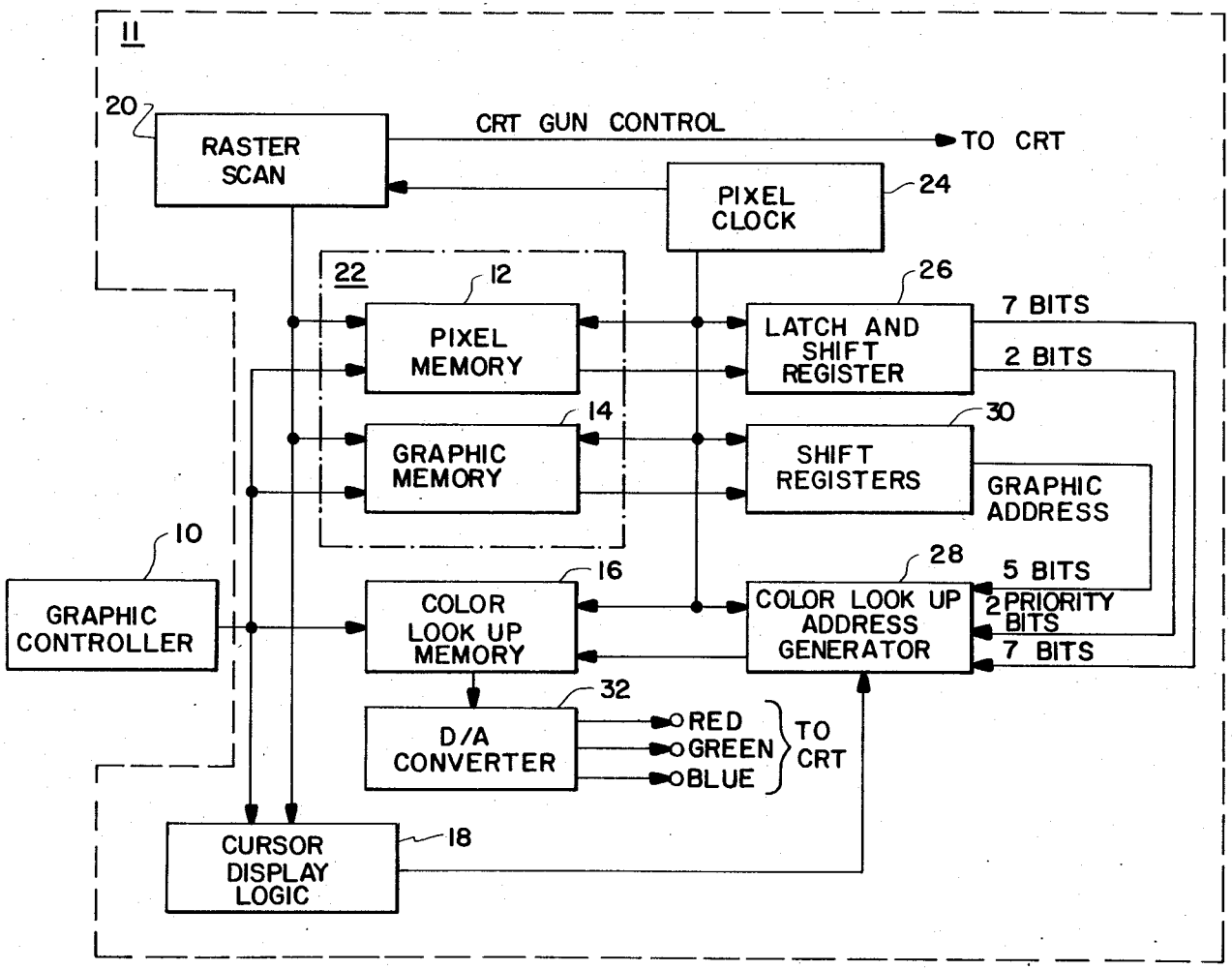
FIG. 1 shows an apparatus for a display generation system.

Referring to FIG. 1, there is shown an apparatus for a display generation system. A graphics processor 10 of the preferred embodiment includes a Motorola 68000 microprocessor (not shown) and an associated RAM (not shown). The graphics processor 10 interfaces with a video display generator 11. The video display generator 11 provides the necessary signals to generate displays on and control of a raster scan CRT monitor (not shown). The video display generator 11 includes various display and control memories 22, 16, a cursor display logic 18, raster scan logic 20, color look-up address generation logic 28, and a D/A converter 32. A pixel clock 24 is included to produce the required clocking signals for the video display generator. Latches and shift registers 26, 30 are operatively coupled to the display memory 22, and along with the clocking signals from the pixel clock 24, data written into shift registers is shifted in a synchronous fashion to correspond to the scanning of the beam of the CRT monitor in order to produce the desired display.

The raster scan logic 20 generates all of the timing and sync signals for the raster scan CRT monitor (not shown) and the necessary timing and control signals for all accesses of the display memories 22. Counters (not shown) in the raster scan logic 20 determine which displayable element on the raster scan CRT monitor is currently being displayed and which address to access in the display memories 22.

The random access display memories 22 are organized in two different forms referred to as the picture element (pixel) memory 12 and the alphagraphic memory (also referred to as the graphic memory) 14. A more detailed description of the format of the pixel memory 12 and the graphic memory 14 will be described in detail hereinunder.

The cursor display logic 18 generates a visible cursor which can be positioned anywhere on the display under control of the graphic controller 10. A more detailed description of the generation of cursors for a raster graphic display can be had by referring to application, U.S. Ser. No. 522,140 filed 08/11/83, entitled "Method and Apparatus for Generating Cursors for a Raster Graphic Display", assigned to the same assignee as the present application.

The color lookup address generation logic 28 determines if the current displayable element is a pixel, alphagraphic, or cursor element (based on the display priority) and uses this determination along with the proper index bits (pixel or alphagraphic) to access a location in the color lookup memory 16. The color lookup memory 16, at locations having addresses corresponding to the color addresses applied by the color lookup address generator logic 28, has stored color control signals which are used to control the intensity of the electron beams of the color guns of a conventional color CRT monitor (not shown) and which determine the color and intensity of each picture element of the display array as it is scanned. An eight-bit byte is stored in the color lookup memory 16 at locations corresponding to the color addresses applied. In synchronism with the scanning of each pixel of the display, the color control signal is read out of color lookup memory 16 and applied to D to A converters 32. D to A converters 32 convert 6 of the 8 binary signals into analog signals for controlling intensity of the red, green, and blue electron beam guns of the conventional CRT monitor. In addition, in the preferred embodiment, two bits of the color control signal are applied to a fourth D to A converter which converts these two bits into a monochrome analog signal which can be used to produce a permanent record of the raster display using conventional equipment, as is well known in the art. A more complete description of the color lookup address generation logic 28 and the associated color lookup memory 16 can be had by referring to U.S. Pat. No. 4,490,797 entitled "Method and Apparatus for Controlling the Display of a Computer Generated Raster Graphic System," assigned to the same assignee as the present application.

Figure 2:
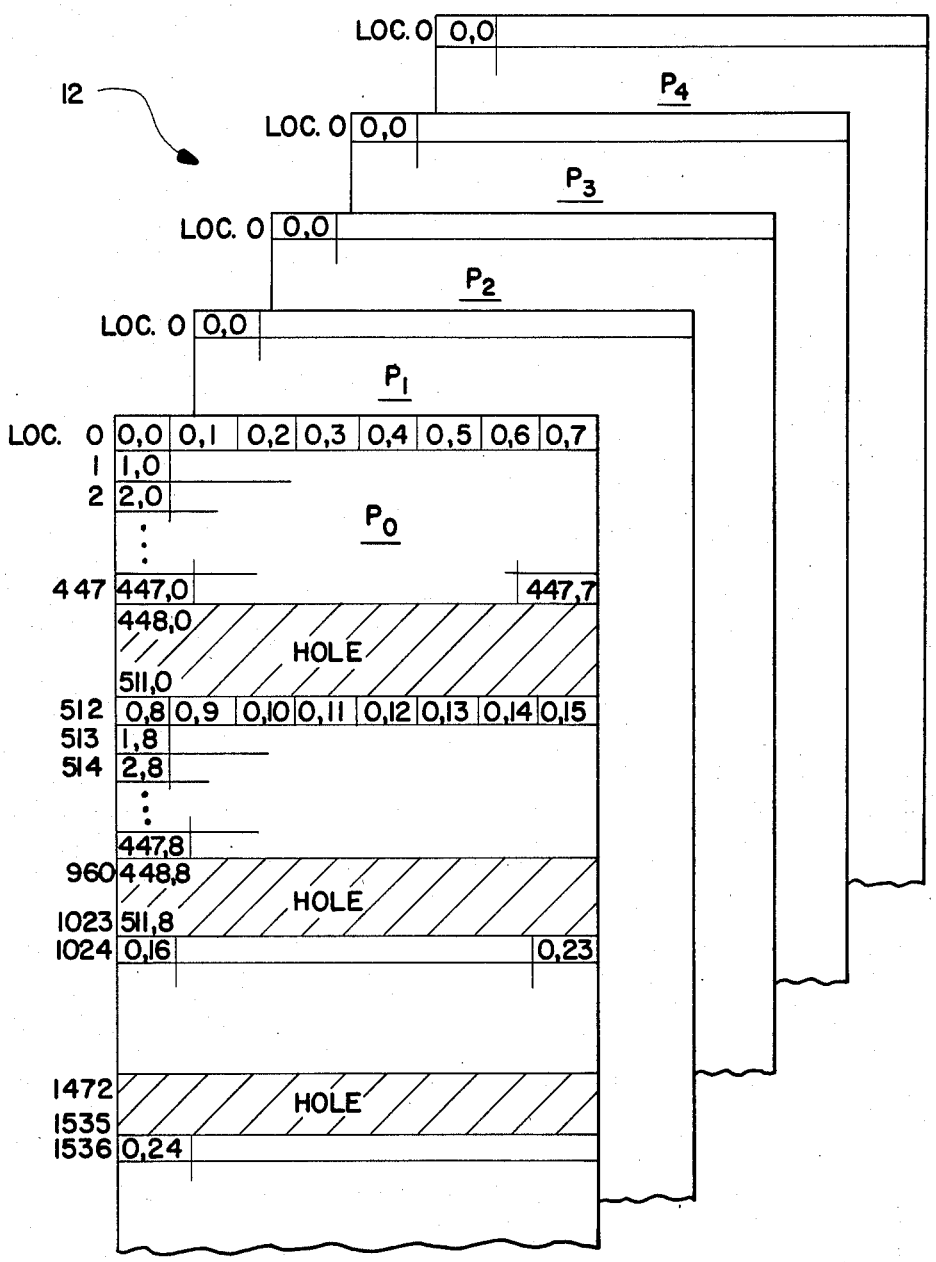
FIG. 2 shows an organization of a pixel memory of the preferred embodiment of the present invention.
Figure 3:
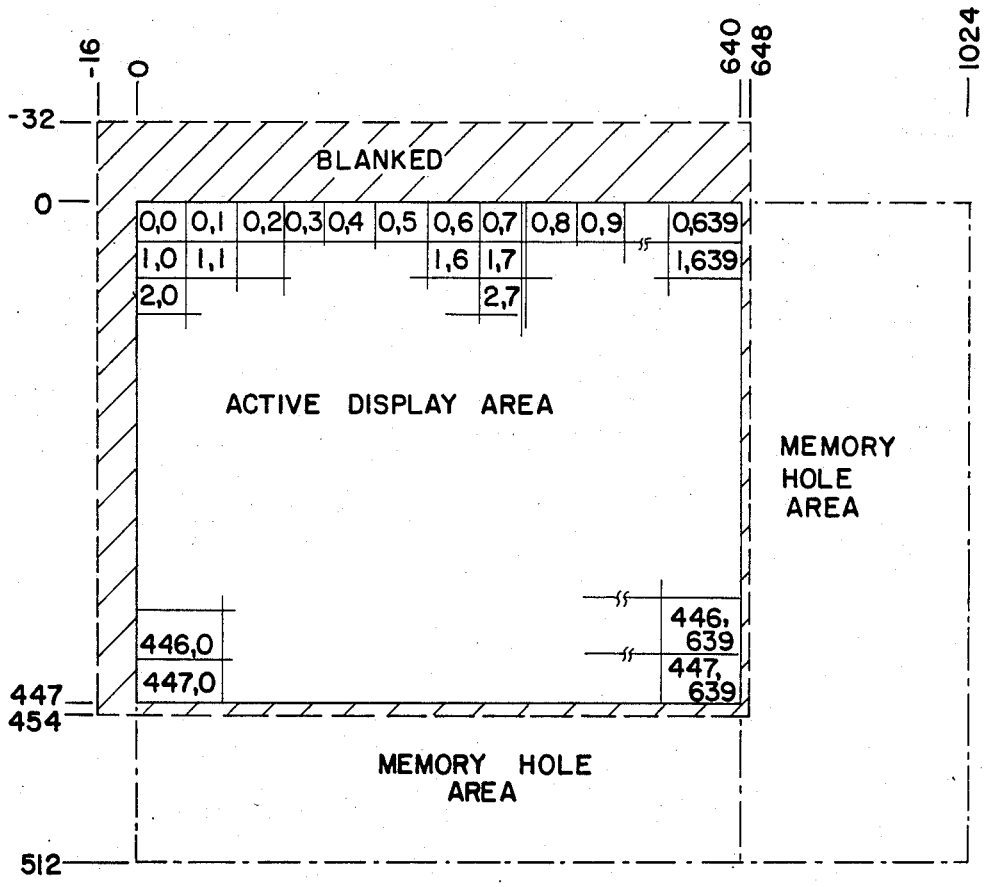
FIG. 3 shows a layout of a CRT display for the preferred embodiment as it corresponds to the pixel memory organization.

FIG. 2 shows an organization of the pixel memory 12 and FIG. 3 shows a layout of the CRT monitor display. Referring to FIGS. 2 and 3, the relationship of the organization of the display memory 22 (although the discussion with respect to FIG. 2 will be specifically directed to the pixel memory 12, there is a similar organization for graphic memory 14) will now be described. The active display area of the CRT monitor of the preferred embodiment of the present invention is divided into 640 horizontal elements and 448 vertical elements. A character size chosen for the display of the preferred embodiment is a $5\times9$ character in an $8\times16$ character cell (i.e., 8 horizontal pixels by 16 vertical pixels). The pixel memory 12 contains five planes, $p_0$, $p_1$, $p_2$, $p_3$, and $p_4$. Each plane is an 8 bit wide by 64K memory. Each location of each plane contains 8 bits of information relating to 8 corresponding picture elements. Hence, location 0 of the pixel memory 12 contains information relating to picture elements 0,0 through 0,7 of the display. The first bit of location 0 of pixel memory 12 contains information relating to picture element 0,0 of the display, the second bit of location 0 of pixel memory 12 contains information relating to picture element 0,1 of the display, . . . In order to display the information of the display memory 22, it is necessary that the information in display memory 22 correspond to the position of the sweep of the CRT monitor (not shown). In raster scan CRT monitors, generally the sweep is a horizontal sweep from left to right, top to bottom, in which the sweep starts at location 0,0 and moves horizontally across the display to location 0,639. Thus, the information fetched from display memory 22 for display must correspond to the positioning of the sweep of the CRT monitor. Namely, location 0 of display memory 22 is fetched which corresponds to picture elements 0,0 through 0,7, then location 512 of display memory 22 is fetched which corresponds to the picture elements 0,8 through 0,15, then location 1024 is fetched . . . up to location 40448 which corresponds to picture element 0,632 through 0,639. The next line of the display (picture element 1, 0 through 1, 639 is scanned and the corresponding information is fetched from the display memory 22 at location 1, 513, 1025, . . . When line 447 is completed, the display has been completed and the scanning is restarted at line 0. The hole area in memory corresponds to the display area 448–511. Hence, locations 448 through 511, 960 through 1023, 1472 through 1535, . . . of display memory 22 have no corresponding active display area. The fetch of the information from display memory 22 is performed by logic in the raster scan logic 20. By adding 1 to bit 9 (i.e., to the 512 bit position) of an address counter, the correct addressing scheme is generated corresponding to the CRT beam as it is swept across a horizontal line. By allowing the hole area in memory, the implementation of incrementing the counter of the raster scan logic is simplified. The area of the display from 640 to 1023 also corresponds to a memory hole area from locations 40960 to 64K (i.e., 65535). The apparent inefficient use of memory is more than negated by the ease of implementing an addressing scheme corresponding to the display layout.

Although a line by line scanning of the display area has been described, it will be understood that alternative vertical scanning techniques may be implemented without departing from the scope of the present display memory organization. For example, interlace scanning may be implemented with the organization of the display memory 22 just described. The raster scan logic would be implemented such that the low order bit position of the counter for accessing the display memory 22 would be alternately set between a 1 and a 0 on alternate vertical scans, by techniques well known in the art.

As discussed above, the character size chosen for the display system of the preferred embodiment is a 5×9 character in an 8×16 character cell. Since the display memory 22 is organized 8 bits wide, which corresponds to 8 horizontal picture elements on the display, the drawing of any character requires 16 write operations into the display memory 22. The data used for the 16 write operations is typically copied from a font table located in a RAM in which the character information is stored in 16 contiguous locations of the font table. A character cell corresponding to the display of the preferred embodiment is also in contiguous memory. Therefore, characters can be made available for display on the screen by using memory to memory block moves from the font memory (not shown) to the display memory 22 which results in less overhead required by the microprocessor of the graphic controller 10.

In a similar fashion, it can be seen that vertical lines are easily stored in the display memory 22 by accessing contiguous memory locations. In this manner, it is said that the display memory 22 is organized to correspond with a "vertical sweep" of the CRT. Horizontal lines which are to be displayed more than 8 picture elements long require accessing the corresponding memory location in the increments of 512 locations as discussed above.

Figure 4:
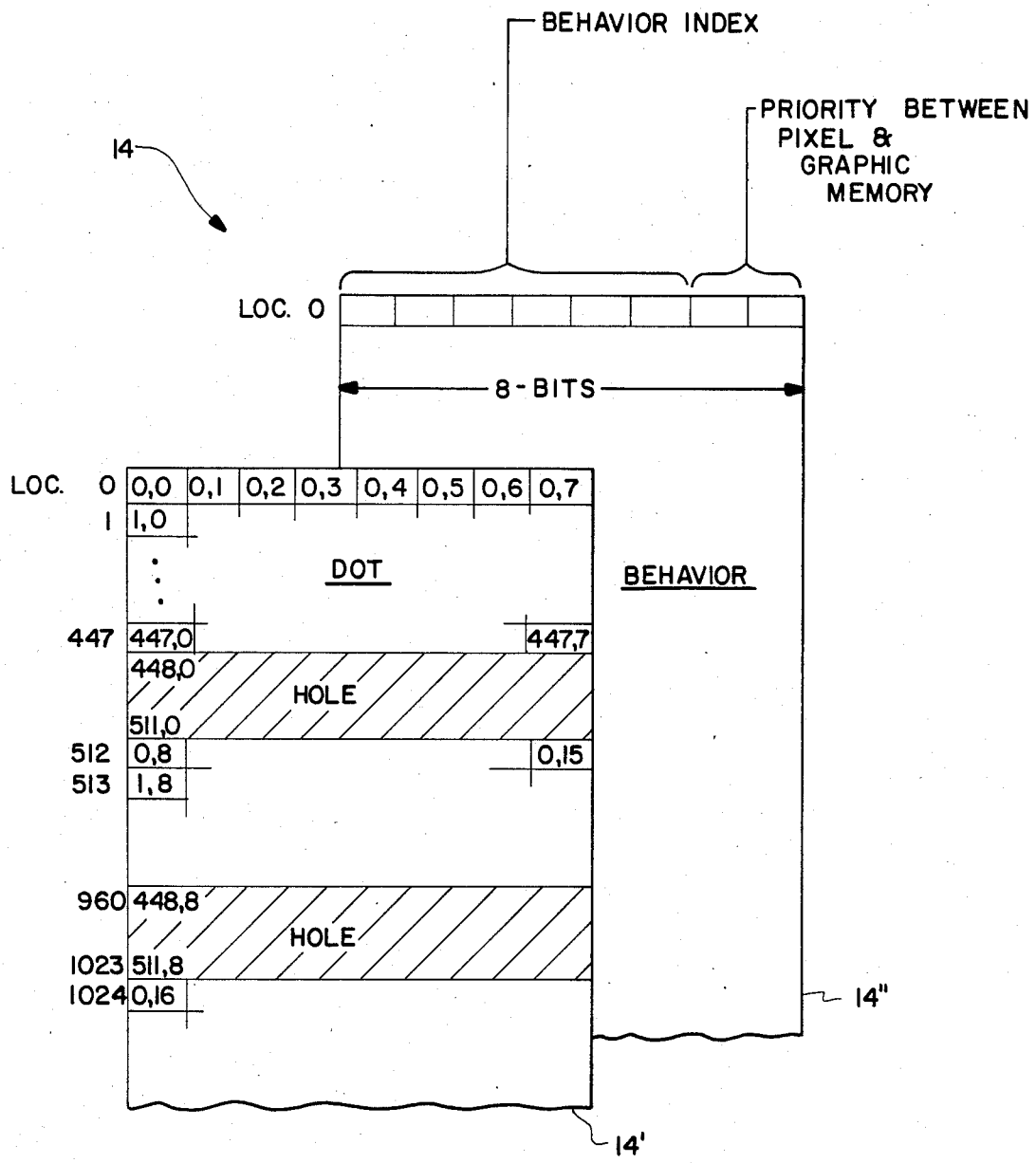
FIG. 4 shows an organization of a graphic memory of the preferred embodiment of the present invention.

Referring to FIG. 4, there is shown an organization of the graphic memory 14. The alphagraphic memory 14 also corresponds to a display which is 640 horizontal elements and 448 vertical elements. The graphic memory 14 consists of 2 memory planes with each plane organized such that each 8-bit byte corresponds to 8 horizontal elements by 1 vertical element. In a first plane, denoted a dot memory 14', each bit determines if the picture element is a foreground or background color. In a second plane, denoted the behavior memory 14'', each 8 bit location determines the behavior index of an entire associate location in the dot memory 14', and the display priority between the pixel memory 12 and the alphagraphic memory 14. Of the 8 bits, a behavior index is 6 bits and a display priority is 2 bits. The 6 bits representing the behavior index and the 1 bit identification of each foreground or background color results in a 7 bit value used as an index into the color lookup memory 16. The 2 priority bits determine the priority of the pixel display with respect to the alphagraphic display. The priority is one of three levels which are more fully described in the aforementioned references. The pixel memory 12 stores characteristic information for each pixel element; namely, planes 0–2 contains color information, plane 3 contains intensity information, and plane 4 contains blink information.

Figure 5:
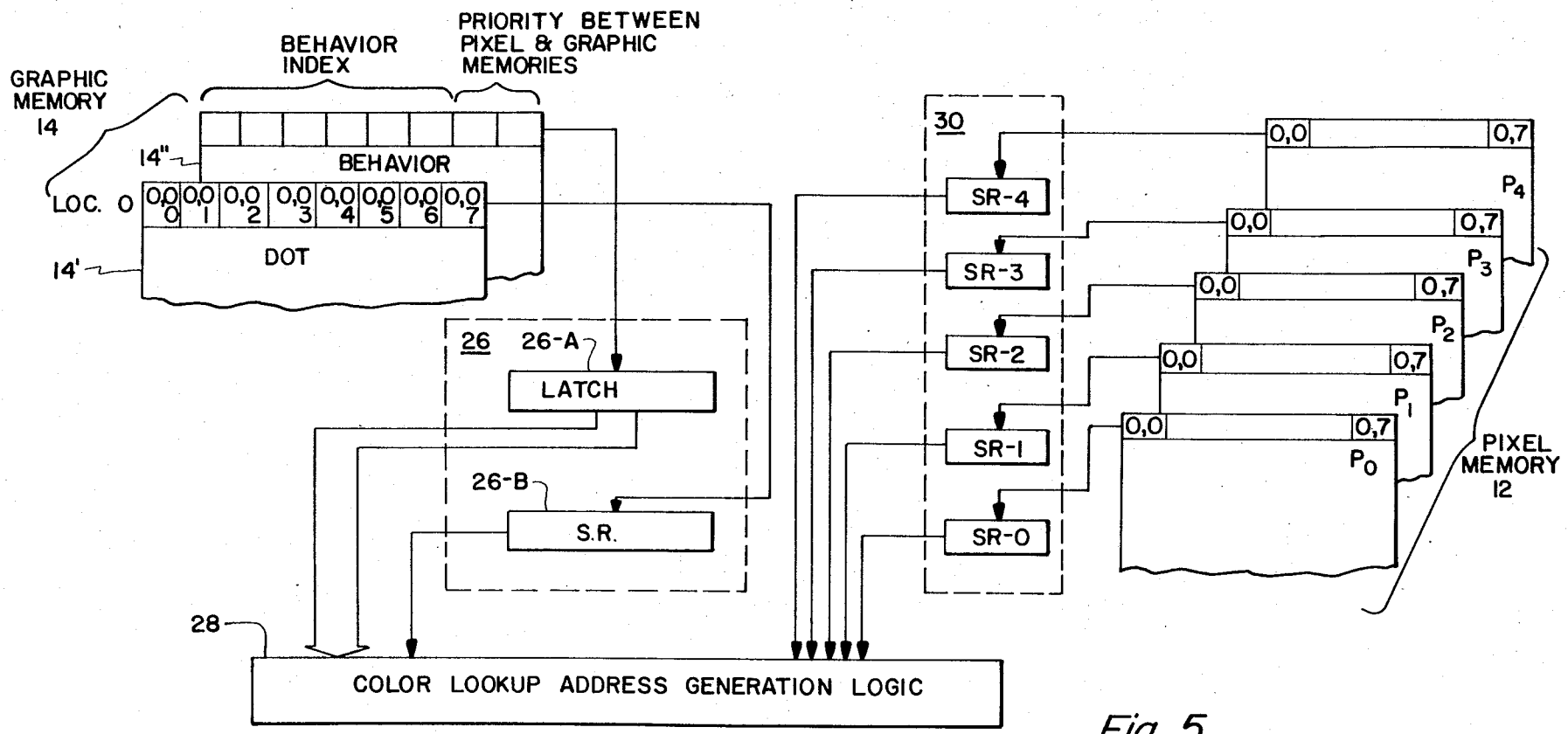
FIG. 5 shows a diagram of some logic included in the displaying of the information of the display memories of the preferred embodiment of the present invention.

Referring to FIG. 5, there is shown some of the logic of the video display generator 11 utilized for displaying the information stored in the display memories 22. The raster scan logic 20 reads the alphagraphic memory 14 and the pixel memory 12 at the same location, in the example shown in FIG. 5 location 0 is being read. The 8 bits from the dot memory 14' are loaded into a shift register 26B and the 8 bits from location 0 of the behavior memory 14'' are being loaded into a latch 26A. Likewise, the contents of location 0 of each plane of the pixel memory 12 is loaded into a corresponding shift register. Thus, the 8 bits of location 0 from plane 0 is loaded into shift register SR-0, the 8 bits from location 0 of plane 1 is loaded into SR-1, . . . , and the 8 bits from location 0 of plane 4 is loaded into SR-4. All of the shift registers are shifted such that the color lookup address generation logic 28 processes the information related to picture element 0,0 from both the pixel memory 12 and the dot memory 14'. Processing is performed to correspond to the information contained in latch 26A. At this point in time the sweep of the CRT monitor is at location 0,0 of the display. Synchronized by the clocking signal, the display moves to the next position, i.e., picture element 0,1 of the display and likewise the information corresponding to location 0,1 is shifted into the color lookup address generation logic 28 from the shift registers 30 and the shift register 26B. Again, this information is processed by the color lookup address generation logic 28 as defined by the information latched in latch 26A, which is valid for the 8 bits of location 0. The process continues until the sweep of the CRT monitor has displayed the 8 picture elements of a horizontal line. The next element to be displayed is location 0,8 which corresponds to address 512. The raster scan logic 20 causes a read of location 512 from the graphic memory 14 and the pixel memory 12 into the shift registers and the above process continues until the entire line is displayed, and then continues as described above until the entire display area has been processed for display.

The display memories 22 can be written into at any time and the display will not be blanked as a result of the display memory access. For every fetch of display data by the raster scan logic 20 there is an equal amount of time allowed for the graphic controller 10 to access the display memory 22. This is done as a result of fetching the display data as a byte of 8 pixels and then shifting the data out of the shift registers 26, 30 to the color lookup logic 16,28. The display access takes 4 pixel times, leaving 4 pixel times for the graphic controller 10 to access the display memory 22. Raster scan logic 20 takes priority over the microprocessor of the graphic controller 10 for display memory access. As a result, in order to avoid wait states by the microprocessor of the graphic controller 10, logic is included in the graphic controller 10 to temporarily store data to be written and the corresponding address into display memory 22 thereby eliminating the wait state for the microprocessor.

Figure 6:
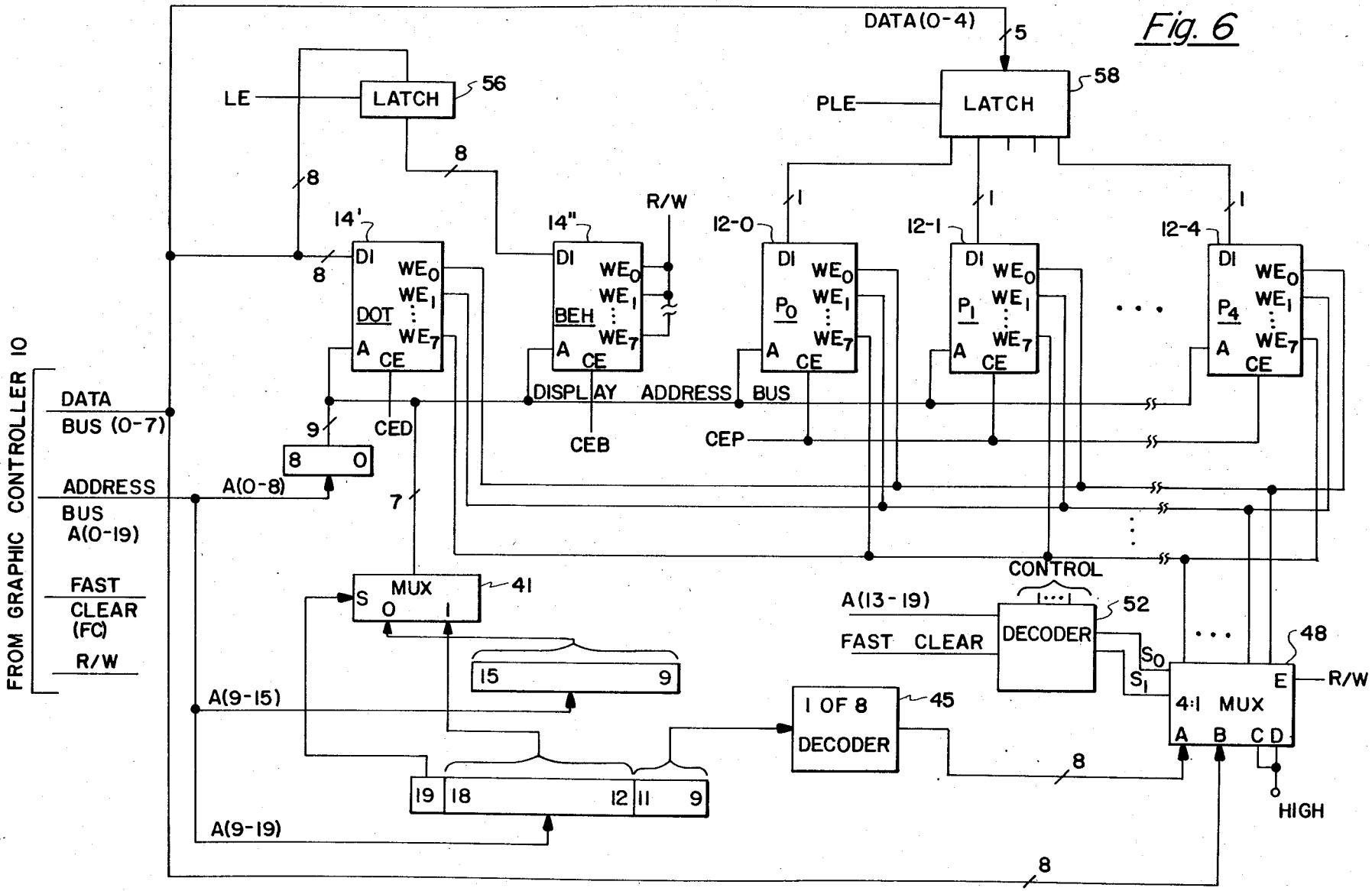
FIG. 6 shows a functional logic block diagram of the apparatus of the preferred embodiment of the present invention for accessing the display memories.

Referring to FIG. 6, there is shown a functional logic block diagram of the apparatus of the preferred embodiment of the present invention for accessing (i.e., storing the data to be displayed) the display memories 22. Plane 0 of pixel memory 12, 12–0, plane 1 of pixel memory 12, 12–1 . . . plane 4 of pixel memory 12, 12–4, dot memory 14' of graphic memory 14, and behavior memory 14'' of graphic memory 14 have their respective address terminals coupled to a display address bus. An address bus, A(0–19), from the graphic controller 10 has its lines A(0–8) coupled to the display address bus. Lines A(9–15) of the address bus are coupled to the 0 side of a multiplexer (MUX) 41. Lines A(12–18) of the address bus are coupled to the one side of the MUX 41. Lines A(9–11) of the address bus are coupled to a one-of-eight decoder 45, and line A(19) of the address bus is coupled to the select terminal of the MUX 41. The output of the MUX 41 is coupled to the display address bus. The output of the one-of-eight decoder 45 is coupled to the A inputs of a four-to-one MUX 48. A data bus, lines 0–7, from the graphic controller 10 are coupled to the B inputs of the four-to-one MUX 48. The C and D inputs of the four-to-one MUX are tied together to a logic high position. The enable terminal of the four-to-one MUX 48 is coupled to a read/write (R/W) control line from the graphic controller 10. A decoder 52 has coupled to the inputs the address lines, A(13–19), and a FAST-CLEAR control line from the graphic controller 10 for generating the select signals S0 and S1 for the four-to-one MUX 48, and some control signals, CONTROL. The decoder 52 will be described in further detail hereinunder.

The display memories 22 of the preferred embodiment of the present invention are dynamic random access memories. Each plane of the display memory 22, that is the dot memory 14', the behavior memory 14", and planes 0 through planes 4 of the pixel memory 12, each consist of an 8×64K memory. Each bit within the 8 bit byte has a corresponding write enable (WE) line for the entire 64K. Hence, $WE_0$ is the write enable line for the 0 bit position of location 0 through 64K, . . . , and $WE_7$ is the write enable line for bit 7 from location 0 through 64K. Also, each memory plane has a chip enable (CE) terminal which enables access to the memory plane. (In the preferred embodiment of the present invention each memory plane is implemented utilizing eight 1×64K dynamic RAM, TI IC chip No. 4164 or equivalent.) The data bus, lines 0–7, are coupled to the data input terminal of the dot memory 14'. Likewise, the data bus, lines 0–7 are coupled to a latch 56, the outputs of the latch being coupled to the data input terminals of the behavior memory 14". The latch enable signal (LE) is a control signal generated by decoder 52 which will be described in further detail hereinunder. Latch 56, an eight bit latch, can be referred to as a transparent latch. The latch 56 can either latch the data written into it or pass the data from the data bus into the behavior memory 14". The latch 56 will always pass the data from the data bus to the outputs of the latch when the latch enable signal is high, or will save the previously latched data on the outputs when the latch enable signal is low.

A pixel latch 58 couples data lines (0–4) from the data bus to the inputs of the pixel latch, the pixel latch 58 being a five bit latch. The output from each position of the pixel latch 58 is coupled to the data input terminals of the corresponding plane of the pixel memory 12. Each of the 8 data input terminals of each of the planes of the pixel memory 12 are tied together. The writing of data in individual bit positions in the pixel memory is accomplished by use of the write enable lines. The pixel latch is enabled via a control signal PLE, which will be described hereinunder.

Since each location of the behavior memory 14" is written into as a byte (i.e., 8 bits), each write enable terminal of the behavior memory 14" is coupled to the R/W line from the graphic controller 10. The 5 planes of the pixel memory and the dot memory 14' have their corresponding write enable lines coupled together, i.e., $WE_0$ of dot memory 14' is coupled to the $WE_0$ of plane 0 of pixel memory 12–0 and is coupled to $WE_0$ of plane 1 of pixel memory 12–1, . . . and is coupled to the $WE_0$ terminal of the pixel memory 12–4, and is coupled to the corresponding output line of the 4 to 1 MUX 48. In a like fashion, each corresponding write enable terminal of each of the 6 planes of the display memories 22 are coupled together and are finally coupled to a corresponding output of the four-to-one MUX 48.

A first access mode of the display memories 22 is the direct access of the dot memory 14'. A second access mode of the display memories 22 is the direct access of the behavior memory 14" with data supplied by the graphics processor 10 (i.e., the latch 56 is transparent). A third access mode is a direct access to both the dot memory 14' and the behavior memory 14" simultaneously the data supplied to the behavior memory 14" being supplied by data latched in latch 56. For the first access mode, the chip enable signal CED must be a logic 1, for the second access mode the chip enable signals CEB must be a logic 1, and for the third access mode the chip enable signals CEB and CED must both be a logic 1 (or high). To establish the desired mode, use is made of address lines A(16–19). Since lines A(0–15) are all that are required to address 64K of display memory 22, lines A (16–19) are used as steering lines and are decoded to generate the desired control signals. Decoder 52 contains the logic to generate control signals, CONTROL, which include signals LE, PLE, CED, CEB, CEP, and select signals $S_0$, $S_1$, in accordance with Table 1. The data being written into the dot memory 14' comes from the 8 bit data bus from the graphics controller 10. The data that is written into the behavior memory 14" comes from the latch 56. The latch 56 can be written to by the graphics controller 10 at any time. The first, second and third access modes correspond to conditions 5, 6, and 3, respectively, of Table 1.

A fourth access mode of the display memory 22 is an access to the pixel memories 12. The data to be written into the pixel memories comes from the pixel latch 58 which can be written into from the graphics controller 10 at any time. In the pixel access mode, address bit 19 is a logic 1 and corresponds to

TABLE 1

| | FAST | ADDRESS BUS | | | | 4:1 MUX | CHIP ENABLE | | |
|---|---|---|---|---|---|---|---|---|---|
| CONDITION | CLEAR | 19 | 18 | 17 | 16 | SELECT | CED | CEB | CEP |
| 1 | X | 1 | X | X | X | A | 0 | 0 | 1 |
| 2 | X | 0 | 1 | 1 | 1 | B | 1 | 1 | 0 |
| 3 | 0 | 0 | 1 | 1 | 0 | C,D | 1 | 1 | 0 |
| 4 | 1 | 0 | 1 | 1 | 0 | C,D | 1 | 1 | 1 |
| 5 | X | 0 | 1 | 0 | 1 | C,D | 1 | 0 | 0 |
| 6 | X | 0 | 1 | 0 | 0 | C,D | 0 | 1 | 0 |
| 7 | X | 0 | 0 | 1 | 1 | B | 0 | 0 | 1 |
| 8 | X | 0 | 0 | 1 | 0 | LATCH ACCESS | 0 | 0 | 0 |
| 9 | X | 0 | 0 | 1 | 0 | NOT APPLICABLE TO DISPLAY | | | |

TABLE 1-continued

| CONDITION | FAST CLEAR | ADDRESS BUS 19 | 18 | 17 | 16 | 4:1 MUX SELECT | CHIP ENABLE CED | CEB | CEP |
|---|---|---|---|---|---|---|---|---|---|
| 10 | X | 0 | 0 | 0 | 0 | MEMORIES | | | |

X = Don't Care
1 = Enable
$A_{19} = 0$ = Byte Access (i.e, Access to Graphic Memory 14)
$A_{18} - \underline{16} =$ Byte Access type
$LE = \overline{19} \cdot \overline{18} \cdot 17 \cdot \overline{16} \cdot \overline{15} \cdot \overline{14} \cdot 13 + \overline{19} \cdot 18 \cdot \overline{17} \cdot \overline{16}$
$PLE = \overline{19} \cdot \overline{18} \cdot 17 \cdot \overline{16} \cdot \overline{15} \cdot 14 \cdot \overline{13}$ condition 1 of Table 1. Lines A9–11 are used to determine which one of the eight bits (i.e., pixels) are to be written into. The four-to-one MUX 48 selects the A inputs for which only one of the eight output lines will be a logic one, that is only one bit position will be changed. The chip enable signal CEP will be a logic one thereby only affecting the pixel memories 12. The corresponding pixel position for each of the five planes of the pixel memories 12 will have data written into corresponding to the data stored in the pixel latch 58.

The fifth and sixth access modes are referred to as parallel access modes. When writing pixels into the display memories, the display memories are organized for optimally generating vertical lines. When a memory address is accessed, the microprocessor of the graphic controller 10 is already set to access the next sequential address in memory on the next access. However, when drawing horizontal lines into the pixel memory, the graphics controller 10 has to calculate a new address for each horizontal pixel, even though the addressing into memories is organized to minimize multiplication algorithms. In the parallel access mode a group of 8 horizontal pixels can be accessed simultaneously and any combination of these 8 pixels can be modified simultaneously. This is accomplished by using a data pattern on the data bus to determine which pixels in the group of 8 are to be modified. The data to be written comes from the pixel latch 58. When using the data pattern on the data bus to control which of the pixels to modify via the WE lines, a logic 1 in the data bit indicates that the pixel should be modified and a logic 0 indicates the pixel is not to be modified. This information is coupled through the B inputs of the four-to-one MUX 48 to the corresponding write enable lines. This corresponds to condition 7 of Table 1 for the pixel memories. The corresponding parallel access for the graphic memories 14 correspond to condition 2 of Table 1.

In order to allow the graphics controller 10 to clear both the alphagraphic memory 14 and the pixel memory 12, an access mode is defined corresponding to condition 4 of Table 1 where both the alphagraphic 14 and pixel memory 12 can be written into simultaneously. When accessing the latches, corresponding to condition 8 of Table 1, the address lines 13 through 15 are used in addition to the four previously mentioned lines, i.e., lines 16–19. Since the display memories 22 contain large hole areas some of these address lines may be used as additional steering lines since the memories are not in the active display area.

Figure 7:
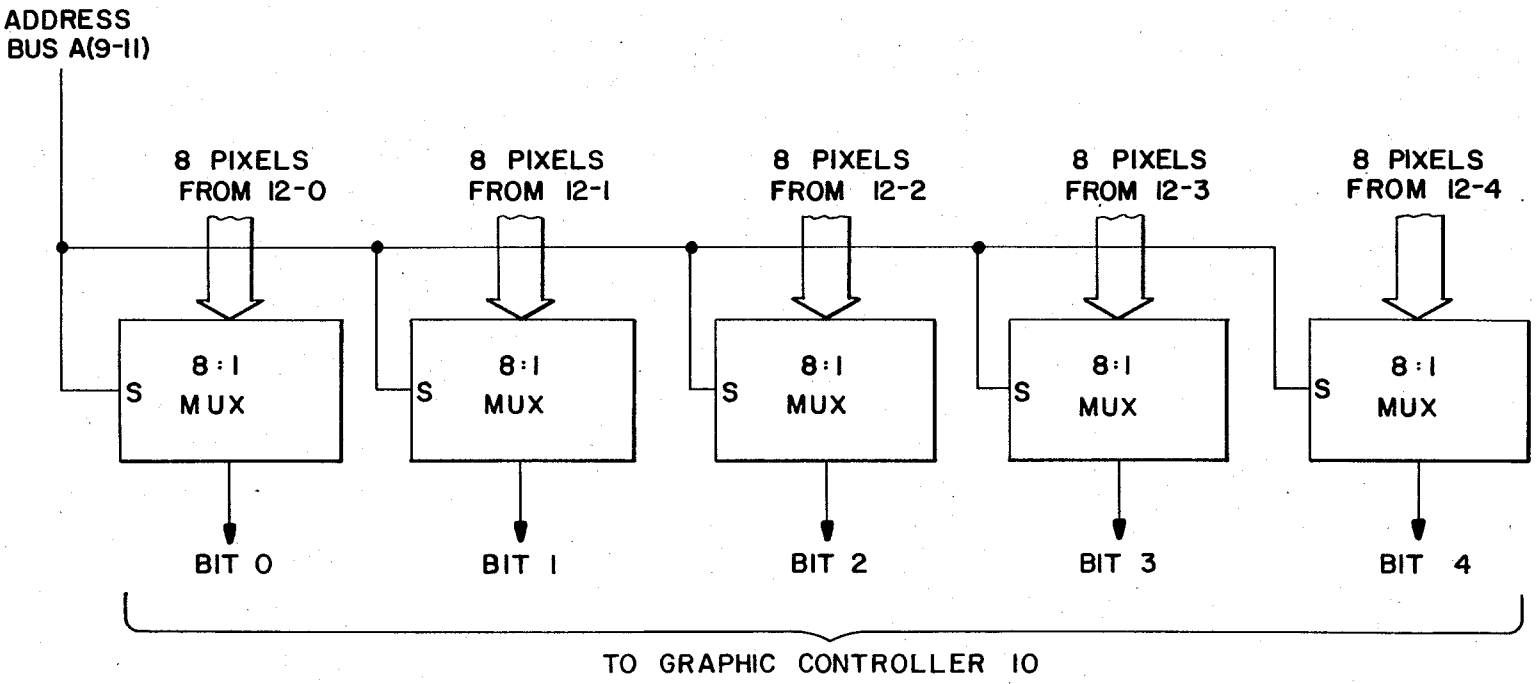
FIG. 7 shows a logic block diagram for reading the pixel memories of the preferred embodiment of the present invention.

Referring to FIG. 7, when the graphics controller 10 reads from the pixel memory 12, a group of 8 pixels from each plane for a total of 40 bits are read. The eight data output lines of each plane of the display memory 22 are not tied together. An 8 bit multiplexer for each plane determines which one of the 8 bits from each plane to transfer to the graphics controller 10. The address bits A(0–8 and 12–18) determine which group of 8 pixels to read and bits A(9,10,11) determine which one of the 8 pixels to pass to the graphics controller 10.

While there has been shown what is considered the preferred embodiment of the present invention, it will be manifest that many changes and modifications can be made therein without departing from the essential spirit and scope of the invention. It is intended, therefore, in the annexed claims to cover all such changes and modifications which fall within the true scope of the invention.

We claim:

1. In a data processing system, having a display system, the display system which includes a central processing unit (CPU) producing data, address and control binary signals, and a display memory for storing binary signals representing information to be displayed, said display memory comprising:

(a) first random access storage means for storing binary dot information;

(b) second random access storage means for storing binary behavior information;

(c) third random access storage means, operatively connected to said first storage means, for storing binary characteristic information, said first, second, and third storage means each having "m" addressable storage locations with each addressable storage location storing "n" bits, where "m" and "n" are integers other than zero, each of said first, second, and third storage means having address terminals operatively connected to a display address bus for receiving concurrently binary address signals representing the addressable storage location from said CPU; and (d) control logic means, having input terminals for receiving selected address signals, data signals, and control signals from said CPU, said control logic means being operatively connected to said first, second and third storage means for generating chip enable control signals said chip enable signals having a predetermined value enabling the storage means to store data signals produced by the CPU in an addressed memory location of the enabled first, second, or third storage means, the chip enable signals having said predetermined value being determined by the address, data, and control signals produced by said CPU and applied to said control logic means.

2. A display memory, according to claim 1, wherein said control logic means produces "n" unit enable control signals at "n" write enable output terminals respectively, each of said first, second, and third storage means having "n" write enable input terminals for receiving a write enable signal, each write enable terminal corresponding to a predetermined bit position within each of the "m" addressable locations of the associated storage means, each write enable terminal of said first storage means being operatively connected to a corresponding write enable terminal of said third storage means and to a corresponding write enable output terminal of said control logic means, said write enable signals having a predetermined value causing the addressed location of an enabled storage means to store a corresponding data signal produced by the CPU.

3. A display memory, according to claim 1, wherein said control logic means further comprises:

(a) decoder means for receiving control and address signals from said CPU, for decoding said signals, and for generating chip enable control signals and latch enable signals; and (b) switch means, operatively connected to said CPU to receive data and decoded data signals and for producing "n" write enable signals at "n" write enable output terminals, said "n" write enable output terminals being operatively connected to "n" write enable terminals of said first and third storage means for determining which bit position of an addressed memory location data signals produced by the CPU are to be written.

4. A display memory, according to claim 3, wherein said second storage means has a write enable terminal for each bit position of an addressable storage location, the write enable terminals of the second storage means being operatively connected to a read/write control terminal of said CPU.

5. A display memory, according to claim 4, wherein said second storage means comprises:

first latch means having input terminals for receiving data signals from the CPU, said first latch means being operatively connected to data input terminals of the second storage means, said second storage means storing data signals from the CPU in response to predetermined one of the chip enable control signals and a latch enable signal applied to said first latch means, whereby said first storage means and said second storage means may have the same data written into addressable storage locations of the first and second storage means having the same address at the same time.

6. A display memory, according to claim 5, wherein said third storage means comprises:

(a) "p" memory planes where "p" is an integer greater than zero, each memory plane having "m" addressable locations and each location storing "n" data bits, each memory plane having a data input terminal corresponding to each of the "n" bits of data stored at each addressable location; and (b) second latch means having "p" stages, each stage of said second latch means having an input terminal adapted to receive a data signal from the CPU, and having a corresponding output terminal operatively connected to each data input terminal of the "p" memory planes of the third memory means for storing data signals from said CPU in response to predetermined chip enable, write enable and latch enable control signals being produced by the control logic.

7. In a data processing system, having a display system having a raster scan CRT having pixels, the display system which includes a central processing unit (CPU) producing data, address, and control, signals and a display memory for storing binary signals determining the color and intensity of the pixels of the CRT as they are scanned, said display memory comprising:

(a) first random access storage means for storing dot information as binary signals;

(b) second random access storage means for storing behavior information as binary signals;

(c) third random access storage means operatively connected to said first storage means for storing characteristic information as binary signals, said first, second and third storage means having at least one memory plane with each memory plane having "m" addressable data storage locations with each storage location storing "n" data bits, where "m" and "n" are integers other than zero, each bit stored in each addressable location of said third storage means when utilized determining the display of a pixel having the same address and wherein all "n" bits of the corresponding "m" addressable locations of said first and second storage means determine the display of "n" pixels having the same address when utilized and determining whether the signals from the third, or first and second storage means have priority for display and further wherein each of said first, second and third storage means has address terminals each operatively connected to a display address for receiving address signals produced by said CPU; and (d) control logic means, having input terminals for receiving address signals, data signals, and control signals from the CPU, said control logic means operatively connected to said first, second, and third storage means, for generating chip enable control signals to selectively enable data to be written into addressed storage locations of predetermined combinations of said first, second, and third storage means responsive to predetermined values of the address, data and control signals produced by the CPU.

8. A display memory, according to claim 7, wherein said control logic means produces "n" write enable control signals at "n" write enable output terminals respectively, each of said first, second and third storage means having "n" write enable input terminals, each write enable terminal corresponding to a predetermined bit position of each addressable storage location, each write enable input terminal of said first storage means being operatively connected to a corresponding write enable input terminal of said third storage means, and to a corresponding write enable output terminal of the control logic means for controlling which data bits are to be written into the first and third storage means during each write operation.

9. A display memory, according to claim 8, wherein said control logic means comprises:

(a) decoder means for receiving control and address signals from the CPU, for decoding said signals to generate chip enable control signals, latch enable control signals and multiplexer select signals; and (b) switch means, operatively connected to the CPU for receiving selected input data signals and decoded data signals and for producing the "n" write enable signals at the "n" write enable output terminals.

10. A display memory, according to claim 9, wherein each write enable terminal of said second storage means is operatively connected to said CPU to receive a read/write control signal produced by the CPU when writing data into said display memory.

11. A display memory, according to claim 10, wherein said second storage means further comprises:

(a) "n" data input terminals; and (b) first latch means, said first latch means having "n" input terminals adapted to receive "n" data signals from said CPU, said first latch means being operatively connected to said data input terminals of said second storage means, said second storage means storing said data signals from the first latch means in response to a predetermined one of said chip enable memory control signals and a latch control signal being produced by the control logic means whereby said first and second storage means may have the same data written into memory locations having the same address simultaneously.

12. A display memory, according to claim 11, wherein said third storage means comprises:

(a) "p" planes, where "p" is an integer greater than zero, each memory plane having a data input terminal; and (b) second latch means, having "p" stages, each stage of said second latch means having an input terminal for receiving a data signal from the CPU and having a corresponding output terminal operatively connected to the data input terminal of the corresponding memory plane of the third storage means, each memory plane when enabled by a chip enable signal storing a data signal in an addressed storage location determined by the address signals produced by the CPU in a bit position determined by a write enable signal produced by the control logic.

* * * * *